United States Patent [19]

Reid

[11] Patent Number: 4,744,881

[45] Date of Patent: May 17, 1988

[54] ANTIOXIDANT MATERIAL AND ITS USE

[75] Inventor: Dwight K. Reid, Houston, Tex.

[73] Assignee: Betz Laboratories, Inc., Trevose, Pa.

[21] Appl. No.: 916,263

[22] Filed: Oct. 7, 1986

Related U.S. Application Data

[63] Continuation-in-part of Ser. No. 678,448, Dec. 5, 1984, abandoned.

[51] Int. Cl.[4] ..... C10G 29/16

[52] U.S. Cl. ..... 208/48 AA; 252/401; 252/403; 44/58; 44/63; 44/72; 44/78

[58] Field of Search ..... 44/58, 63, 72, 78; 208/44 AA; 252/401, 403

[56] References Cited

U.S. PATENT DOCUMENTS

| | | | |
|---|---|---|---|
| 1,992,014 | 2/1935 | Rogers et al. | 44/9 |
| 2,027,462 | 1/1936 | Ayres et al. | 252/401 X |
| 2,295,773 | 9/1942 | Chenicek | 44/66 |
| 2,305,673 | 12/1942 | Chenicek | 44/72 |
| 2,305,676 | 12/1942 | Chenicek | 44/72 |
| 2,318,196 | 4/1943 | Chenicek | 44/63 |
| 2,329,251 | 9/1943 | Chenicek | 44/66 |
| 2,333,294 | 11/1943 | Chenicek | 44/72 |
| 2,373,631 | 4/1945 | Mital | 44/69 |
| 2,908,558 | 10/1959 | Brimer | 44/75 |
| 2,917,377 | 12/1959 | Smith | 44/72 |
| 3,033,662 | 5/1962 | Thompson et al. | 44/63 X |
| 3,371,048 | 2/1968 | Cyba | 252/401 X |
| 3,523,141 | 8/1970 | Sakashita | 208/48 AA |
| 3,654,129 | 4/1972 | Bloch | 208/48 AA |
| 4,009,094 | 2/1977 | Cole et al. | 208/48 AA |
| 4,011,057 | 3/1977 | Sayers | 44/72 X |
| 4,100,082 | 7/1978 | Clason et al. | 44/58 X |
| 4,320,020 | 3/1982 | Lange | 44/58 X |
| 4,456,526 | 6/1984 | Miller et al. | 208/48 AA |

OTHER PUBLICATIONS

Lundberg, W. O. (Ed.), *Autoxidation and Antioxidants*, vol. II, Interscience Publishers, N.Y. (1962) pp. 701–730.

*Primary Examiner*—Matthew A. Thexton
*Attorney, Agent, or Firm*—Alexander D. Ricci

[57] ABSTRACT

The present invention is directed to antioxidant materials and their use in petroleum and petrochemical processes to reduce and/or control fouling problems specifically as regards hydrocarbons having a bromine number of greater than 10 and containing oxygen. The inventive antioxidant materials are composed of non-hindered or partially hindered phenols in combination with a strongly basic material such as an organo amine.

27 Claims, No Drawings

ANTIOXIDANT MATERIAL AND ITS USE

This application is a continuation-in-part of application Ser. No. 678,448, filed Dec. 5, 1984, now abandoned.

BACKGROUND OF THE INVENTION

Fouling can be defined as the accumulation of unwanted matter on heat transfer surfaces. This deposition can be very costly in refinery and petrochemical plants since it increases fuel usage, results in interrupted operations and production losses and increases maintenance costs.

Deposits are found in a variety of equipment: preheat exchangers, overhead condensers, furnaces, fractionating towers, reboilers, compressors and reactor beds. These deposits are complex; broadly, they can be characterized as organic and inorganic. They consist of metal oxides and sulfides, soluble organic metals, organic polymers, coke, salt and various other particulate matter. Chemical antifoulants have been developed that effectively combat fouling.

The chemical composition of organic foulants is rarely identified completely. Organic fouling is caused by insoluble polymers which sometimes are degraded to coke. The polymers are usually formed by reactions of unsaturated hydrocarbons, although any hydrocarbon can polymerize. Generally, olefins tend to polymerize more readily than aromatics, which in turn polymerize more readily than paraffins. Trace organic materials containing hetero atoms such as nitrogen, oxygen and sulfur also contribute to polymerization.

Polymers are generally formed by free radical chain reactions. These reactions, shown below, consist of two phases, an initiation phase and a propagation phase. In reaction 1, the chain initiation reaction, a free radical represented by $R^{\cdot}$, is formed (the symbol $R^{\cdot}$ can be any hydrocarbon). These free radicals, which have an odd electron, act as chain carriers. During chain propagation, additional free radicals are formed and the hydrocarbon molecules (R) grow larger and larger (see reaction 4), forming the unwanted polymers which accumulate on heat transfer surfaces.

Chain reactions can be triggered in several ways. In reaction 1, heat starts the chain. Example: when a reactive molecule such as an olefin or a diolefin is heated, a free radical is produced. Another way a chain reaction starts is shown in reaction 3. Here metal ions initiate free radical formation. Accelerating polymerization by oxygen and metals can be seen by reviewing reactions 2 and 3.

As polymers form, more polymers begin to adhere to the heat transfer surfaces. The hearing process results in dehydrogenation of the hydrocarbon and eventually the polymer is converted to coke.

1. Chain Initiation $$R{-}H \rightarrow R^{\cdot} + H^{\cdot}$$

2. Chain Propagation a. $R^{\cdot} + O_2 \rightarrow R{-}O{-}O^{\cdot}$ b. $R{-}O{-}O^{\cdot} + R'{-}H \rightarrow R^{\cdot} + R{-}O{-}O{-}H$ 3. Chain Initiation a. $Me^{++} + RH \rightarrow Me^{+} + R^{\cdot} + H^{+}$ b. $Me^{++} + R{-}O{-}O{-}H \rightarrow Me^{+} + R{-}O{-}O^{\cdot} + H^{+}$ 4. Chain Termination a. $R^{\cdot} + R^{\cdot} \rightarrow R{-}R'$ b. $R^{\cdot} + R{-}O{-}O^{\cdot} \rightarrow R{-}O{-}O{-}R$ In refineries, deposits usually contain both organic and inorganic compounds. This makes the identification of the exact cause of fouling extremely difficult. Even if it were possible to precisely identify every single deposite constituent, this would not quarantee uncovering the cause of the problem. Assumptions are often erroneously made that if a deposit is predominantly a certain compound, that compound is the cause of the fouling. In reality, a minor constituent in the deposit could be acting as a binder, a catalyst, or in some role that influences actual deposit formation.

The final form of the deposit as viewed by analytical chemists may not always indicate its origin or cause. Before openings, equipment is steamed, waterwashed, or otherwise readied for inspection. During this preparation, fouling matter can be changed both physically and chemically. For example, water-soluble salts can be washed away or certain deposit constituents oxidized to another form.

In petrochemical plants, fouling matter is often organic. Fouling can be severe when monomers convert tc polymers before they leave the plant. This can occur in streams high in ethylene, propylene, butadiene, sytrene and other unsaturates. Probable locations for such reactions include units where the unsaturates are being handled or purified, or in streams which contain these reactive materials only as contaminants.

Even though some petrochemical fouling problems seem similar, subtle differences in feedstock, processing schemes, equipment and contaminants can lead to variations in fouling severity. For example, ethylene plant depropanizer reboilers experience fouling that appears to be primarily polybutadiene in nature. The severity of this problem varies significantly from plant to plant, however. Average reboiler run length may vary from one to two weeks up to four to six months (without chemical treatment).

Although it is usually impractical to identify the fouling problem by analytical techniques alone, this information, along with knowledge of the process, processing conditions and the factors that contribute to fouling, are all essential to understanding the problem.

There are many ways, mechanical as well as chemical, to reduce fouling. Chemical additivies offer an effective means; however, processing changes, mechanical modifications equipment and other methods available to the plant should not be overlooked.

Antifoulants are formulated from several materials: some prevent foulants from forming, others prevent foulants from depositing on heat transfer equipment. Materials that prevent deposit formation include antioxidants, metal coordinators and corrosion inhibitors. Compounds that prevent deposition are surfactants which act as detergents or dispersants. Different combinations of these properties are blended to provide maximum results for different applications. These "polyfunctional" antifoulants are generally more versatile and effective since they are designed to combat various types of fouling that can be present in any given system.

Research indicates that even very small amounts of oxygen can cause or accelerate polymerization. Accordingly, antioxidant-type antifoulants have been developed to prevent oxygen from initiating polymerization. Antioxidants act as chain-stoppers by forming inert molecules with the oxidized free radical hydrocarbons, in accordance with the following reaction:

Chain Termination $$ROO^{\cdot} \text{ Antioxidant} \rightarrow ROOH + \text{Antioxidant (H)}$$

Surface modifiers or detergents change metal surface characteristics to prevent foulants from depositing. Dispersants or stabilizers prevent insoluble polymers, coke and other particulate matter from agglomerating into large particles which can settle out of the process stream and adhere to metal surfaces of process equipment. They also modify the particle surface so that polymerization cannot readily take place.

Antifoulants are designed to prevent equipment surfaces from fouling. They are not designed for clean up. Therefore, an antifoulant should be started immediately after equipment is cleaned. It is usually good to pretreat the system at double the recommended dosage for two or three weeks to reduce the initial high rate of fouling immediately after startup.

The increased profit possible with antifoulants varies from application to application. It can include an increase in production, fuel savings, maintenance savings and other savings from greater operating efficiency.

There are many areas in the hydrocarbon processing industry where antifoulants have been used successfully; the main treatment areas are discussed below.

In a refinery, the crude unit has been the focus of attention, especially because of fuel costs. Antifoulants have been successfully applied at the exchangers; downstream and upstream of the desalter, on the product side of the preheat train, on both sides of the desalter makeup water exchanger, and at the sour water stripper.

Hydrodesulfurization units of all types experience preheat fouling problems. Among those that have been successfully treated are reformer pretreaters processing both straight run and coker naphtha, desulfurizers processing catalytically cracked and coker gas oils, and distillate hydrotreaters. In one case, fouling of a Unifiner stripper column was solved by applying a corrosion inhibitor upstream of the problem source.

Unsaturated and saturated gas plants (refinery vapor recovery units) experience fouling in the various fractionation columns, reboilers and compressors. In some cases, a corrosion control program along with the antifoulant program gave the best results. In other cases, antifoulants alone were enough to solve the problem.

Cat cracker preheat exchanger fouling, both at the vacuum, column and at the cat cracker itself, has also been corrected by the use of antifoulants.

In petrochemical plants, the two most prevalent areas for fouling problems are ethylene and styrene plants. In an ethylene plant, the furnace gas compressors, the various fractionating columns and reboilers are subject to fouling. Polyfunctional antifoulants, for the most part, have provided good results in these areas. Fouling can also be a problem at the butadiene extraction area. Both antioxidants and polyfunctional antifoulants have been used with good results.

In the different design butadiene plants, absorption oil fouling and distillation column and reboiler fouling have been corrected with various types of antifoulants.

Chlorinated hydrocarbon plants, such as VCM, EDC and perchloroethane and trichloroethane have all experienced various types of fouling problems. The metal-coordinating/*antioxidant-type* antifoulants give excellent service in these areas. The present invention is directed to antioxidant compositions and their use in controlling fouling which generally occurs during petroleum and petrochemical processing as above exemplified. More specifically, the present invention is applicable to those hydrocarbon processing systems where the hydrocarbon contains unsaturated or olefinic components which are easily induced to polymerize or react by the presence of oxygen.

DESCRIPTION OF THE INVENTION

The present invention relates to the formulation of specific phenolic antioxidants in a non-aqueous medium which incorporates a sufficient amount of a specific oil soluble amine base such that the antioxidant material would experience a basic environment and would at the same time be soluble in a hydrocarbon medium. The specific phenolic antioxidants encompassed by the invention include any unhindered or partially hindered phenol. Unhindered phenols with electron donating groups such as an alkyl or alkoxy group (OX) where the alkyl (X) contains from 1 to 10 carbon atoms, amine group ($-NH_2$) or an alkyl substituted amine, in the para position.

The phenols utilizable are those that have the structural formula

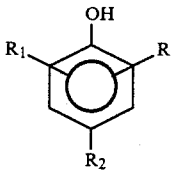

wherein R and $R_1$ are selected from the group consisting of hydrogen and carbon groupings (1 to 8 carbon atoms), with the proviso that not more than one of R and $R_1$ be secondary or tertiary carbon grouping, and $R_2$ is alkyl, alkoxy or an amine grouping.

Specific examples of the phenols include, but are not limited to, p-cresol, p-methoxyphenol, p-amino-phenol, p-(p-methoxybenzylideneamino)phenol, and 2-tert-butyl-4-methoxyphenol (butylated hydroxyanisole).

The oil soluble strong amine bases which are used in conjunction with the phenol are those amine bases that have a $pK_b$ less than 10. These amines may be exemplified by monoethanolamine, N(2-aminoethyl)piperazine, cyclohexylamine, 1,3-cyclohexanebis(methylamine), 2,5-dimethylaniline, 2,6-dimethylaniline, diethylenetriamine, triethylenetetramine, and generally any amine which has the $NR_5R_6R_7$ where $R_5$, $R_6$ and $R_7$ are hydrogen, alkyl, aryl, or substituted alkyl or aryl or in any combination thereof. It has been unexpectedly determined that the presence of the amine in small percentages by weight (active) of the phenol to amine of 98:2 to 2:98 and preferably 40 to 60 enhances the antioxidant capabilities of the phenol. The test data recorded hereinafter will in fact illustrate this conclusively.

The treatment range for the composition, i.e., amine/-phenol, clearly is dependent upon the severity of the fouling problem due to free radical polymerization encountered as well as the activity and constituency of the combination utilized. For this reason, the success of the treatment is totally dependent upon the use of a sufficient amount of the purpose of whatever the composition of choice is. Broadly speaking, the treatment recommendation could be in the range of 0.1 to 2000 parts per million of petroleum or petrochemical being processed with perhaps 10 to 200 ppm being applicable in most cases.

The hydrocarbons where the compositions of the present invention are effective are those which contain unsaturated or olefinic components which components are induced by the presence of oxygen to polymerize or react. As a general rule, any hydrocarbon media having a bromine number greater than 10 would be such where fouling due to oxygen induced reactions would be a problem. These hydrocarbons, where such is the case, include refinery naphtha and gas oils, pyrolysis gasolines, de-ethanizer bottoms, de-propanizer bottoms, de-butanizer bottoms, de-pentanizer bottoms, isoprene, cycle oils, butadiene, acrylates, and vinyl monomers.

SPECIFIC EMBODIMENTS

The ASTM test method D-525 (hereby incorporated by reference) was carried out under accelerated conditions (high $O_2$ content) that would normally not be experienced in an actual field environment. Nevertheless, when examining potential antioxidant candidates, the test provides reliable data on the effectiveness of a given antioxidant material to inhibit the polymerization of certain components within petroleum feedstocks where oxygen is present.

The method (ASTM D-525) covers the determination of the stability of gasoline under accelerated oxidation conditions.

According to the procedure the sample is oxidized in a bomb initially filled with oxygen. The pressure is read at stated intervals or recorded continuously until the break point is reached. The time required for the sample to reach this point is the observed induction period at the temperature of the test.

The induction period may be used as an indication of the tendency of gasoline to form gum in storage. In accordance with the test, an increase in induction time indicates that the candidate antioxidant material is performing its function. Further difunctional aspects and the actual procedure can be determined from an actual review of the test procedures described in ASTM D-525.

The results of the testing were as follows:

TABLE 1

| Sample | Additive | Active Conc. (ppm) | Induction Time (min.) |
|---|---|---|---|
| WITHOUT AMINE | | | |
| 1. Pyrolysis gasoline[a] | None | — | 10 |
| 2. Pyrolysis gasoline[a] | p-[p-methoxybenzylidine amino] phenol[b] | 200 | 55 |
| 3. Pyrolysis gasoline[a] | p-methoxy phenol[c] | 200 | 55 |
| 4. Pyrolysis gasoline[a] | Butylated hydroxyanisole[c] | 200 | 105 |
| 5. Pyrolysis gasoline[a] | p-cresol[c] | 200 | 10 |
| WITH AMINE 300 ppm N—(2-Amino-ethyl) Piperazine (AEP) $pK_b \cong 3$ | | | |

TABLE 1-continued

| Sample | Additive | Active Conc. (ppm) | Induction Time (min.) |
|---|---|---|---|
| 2. Pyrolysis gasoline[a] | p-[p-methoxybenzylidine amino] phenol[c] | 200 | 160 |
| 3. Pyrolysis gasoline[a] | p-methoxy phenol[c] | 200 | 105 |
| 4. Pyrolysis gasoline[a] | Butylated hydroxyanisole[c] | 200 | 160 |
| 5. Pyrolysis gasoline[a] | p-cresol[c] | 200 | 20 |
| 6. Pyrolysis gasoline[a] | AEP[c] | 300 | 10 |

[a]This type hydrocarbon generally possesses a bromine number of about 50 (range of 30 to 80).
[b]Added as a 20% solution in DMF.
[c]Added as a 20% solution in HAN.

Pyrolysis gasoline is indeed quite different from finished product gasoline in that it is a product resulting from the recombination reactions during the cracking and quench processes followed in an olefin plant. Pyrolsis gasoline is not itself a finished product since it contains not only a highly olefinic and aromatic hydrocarbon content, but also has a whole host of other non-hydrocarbons as well as some hydrocarbon impurities. Because of the olefinic ingredients of pyrolysis gasoline, polymerization potential is quite high, thereby giving rise to the deposits described in the instant specification. Accordingly, it was concluded that if the combinations were effective in this highly oxygen-influenced medium, such should indeed be effective in others having the same type constituents.

The descriptions in U.S. Pat. Nos. 3,470,085 and 4,097,367 are supportive of the choice of pyrolysis gasoline as the test vehicle.

Additional tests were conducted to illustrate the effectiveness of the invention as claimed. The reasons for the testing are set forth in the respective tables.

TABLE 2

The effect of various additives, solvents and amines with pyrolysis gasoline on the induction period using test method described in ASTM D-525.

| Sample | Additive | Active Conc. (ppm) | Solvent | Induction Time (min.) |
|---|---|---|---|---|
| 1. Pyrolysis gasoline (A) | None | None | None | 10 |
| 2. Pyrolysis gasoline (B) | None | None | None | 15 |
| 3. Pyrolysis gasoline (A) | p-[p-methoxybenzylidene amino] phenol | 200 | DMF (300 ppm) (dimethyl formamide) | 55 |
| 4. Pyrolysis gasoline (A) | p-[p-methoxybenzylidene amino] phenol | 200 | DMF (150 ppm) + Hexylene Glycol (150 ppm) | 55 |
| 5. Pyrolysis gasoline (B) | DMF | 300 | DMF | 15 |
| 6. Pyrolysis gasoline (B) | HAN | 300 | HAN (heavy aromatic naphtha) | 15 |
| 7. Pyrolysis gasoline (B) | Butylated* Hydroxytoluene (BHT) | 100 | HAN | 43 |
| 8. Pyrolysis gasoline (B) | Butylated* Hydroxytoluene (BHT) | 100 | Cyclohexylamine** (12.5 ppm) | 41 |

TABLE 2-continued

The effect of various additives, solvents and amines with pyrolysis gasoline on the induction period using test method described in ASTM D-525.

| Sample | Additive | Active Conc. (ppm) | Solvent | Induction Time (min.) |
|---|---|---|---|---|
| | | | HAN (137.5 ppm) | |

*Strongly hindered phenol
**Strongly basic amine

TABLE 4

The effect of basicity of the amine on the antioxidant properties of some phenols in pyrolysis gasoline as measured using the test method describe in ASTM D-525.

| Additive | Active Conc. (ppm) | Observed Induction Period (Min.) | Expected Induction Period[(1)] (Min.) | Percent Synergism |
|---|---|---|---|---|
| 1. None | 0 | 13 | — | — |
| 2. HAN | 300 | 13 | — | — |
| 3. Cyclohexylamine* | 300 | 23 | — | — |
| 4. 2,6-Dimethylaniline** | 300 | 24 | — | — |
| 5. Aminoethylpiperazine** | 300 | 16 | — | — |
| 6. BHA | 200 | 110 | — | — |
| 7. BHT | 200 | 33 | — | — |
| 8. BHA Cyclohexylamine | 200 300 | 157 | 120 | 36 |
| 9. BHA 2,6-Dimethylaniline | 200 300 | 128.5 | 121 | 7 |
| 10. BHA Aminoethylpiperazine | 200 300 | 160 | 113 | 47 |
| 11. BHT Cyclohexylamine | 200 300 | 37 | 43 | |
| 12. BHT 2,6-Dimethylaniline | 200 300 | 45 | 44 | 2 |
| 13. BHT Aminoethylpiperazine | 200 300 | 35 | 36 | |

[(1)]Calculated by adding the observed induction period of the phenol and amine, then subtracting the induction period of pyrolysis gasoline without additive.
*$pK_b \cong 4$
**$pK_b \cong 9$ (weakly basic amine)
***$pK_b \cong 3$

TABLE 3

The effect of various additives on the induction period of isoprene using test method described in ASTM D-525.

| Sample | Additive | Active Conc. (ppm) | Solvent | Induction Time (min.) |
|---|---|---|---|---|
| 1. Isoprene[(a)] | None | None | None | 61 |
| 2. Isoprene | Butylated Hydroxyanisole (BHA) | 20 | HAN | 70 |
| 3. Isoprene | Butylated Hydroxyanisole (BHA) | 20 | N—(2-aminoethyl) piperazine (30 ppm) | 120 |

[(a)]Bromine number of about 225.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. A method of controlling fouling during the processing of a hydrocarbon having a bromine number greater than 10 and containing substituents which are induced by oxygen to react to form fouling materials, which comprises adding to the petroleum or petrochemical being processed a sufficient amount for the purpose of an antioxidant composition comprising (a) an unhindered or partially hindered phenol which possesses the following formula:

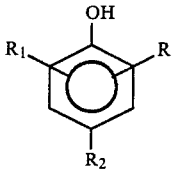

wherein R and $R_1$ are selected from the group consisting of hydrogen and carbon groupings, with the proviso that not more than one of R and $R_1$ be a secondary or tertiary carbon grouping and $R_2$ is alkyl, alkoxy or an amine group; and (b) at least one oil soluble strongly basic amine compound selected from the group consisting of aminoethylpiperazine and cyclohexylamine.

2. A method according to claim 1 wherein the composition is added to said system in an amount of from 0.1 to 2000 ppm of the petroleum or petrochemical being processed.

3. A method according to claim 2 wherein the phenol is selected from the group consisting of butylated hydroxyanisole, p-cresol, p-methoxyphenol, p-aminophenol, and.

4. A method according to claim 3 wherein the amine is N-(2-aminoethyl)piperazine.

5. A method according to claim 4 wherein the composition is in an organic solvent.

6. A method according to claim 1 wherein the phenol and the amine are present in a weight ratio of 2 to 98 to 98 to 2.

7. A method according to claim 6 wherein the composition comprises a weight ratio of amine to phenol of 1.5.

8. A method according to claim 7 wherein the composition is further contained in an organic solvent.

9. A method according to claim 8 wherein the solvent is a heavy aromatic naphtha, dimethylformamide or mixtures thereof.

10. A method according to claim 2 wherein the hydrocarbon being processed is selected from the group of pyrolysis gasoline or isoprene.

11. A method according to claim 10 wherein the phenol is selected from the group of butylated hydroxyanisole, methoxybenzylidene aminophenol and methoxyphenol and said amine is aminoethylpiperazine or cyclohexylamine.

12. A method according to claim 11 wherein the phenol and the amine are present in a weight ratio of 2:98 to 98:2.

13. A method according to claim 3 wherein the amine is cyclohexylamine.

14. A method according to claim 24 wherein the amine and phenol are present in said composition in a ratio by weight of 98:2 to 2:98 and said composition is contained in an organic medium.

15. A composition for use as an antioxidant in petroleum or petrochemical processing systems comprising (a) an unhindered or partially hindered phenol possessing the formula

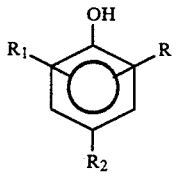

wherein R and $R_1$ are selected from the group consisting of hydrogen and a carbon containing group, with the proviso that not more than one of R or $R_1$ be a secondary or tertiary carbon grouping and $R_2$ is alkyl, alkoxy or an amino group; and (b) at least one strongly basic amine compound selected from the group consisting of aminoethylpiperazine and cyclohexylamine.

16. A composition according to claim 15 wherein the composition is contained in an organic medium.

17. A composition according to claim 16 wherein the amine is in sufficient amount to assure the solubility of said phenol in said medium.

18. A composition according to claim 15 or 12 where the amine and phenol are present in said composition in a percentage by weight of 98:2 to 2:98.

19. A composition according to claim 18 wherein the ratio by weight of amine to phenol is 1.5.

20. A composition according to claim 15 wherein said phenol is selected from the group consisting of butylated hydroxyanisole, p-cresol, p-methoxyphenol, p-aminophenol, and.

21. A composition according to claim 20 wherein the amine is N-(2-aminoethyl)piperazine).

22. A composition according to claim 21 wherein the amine and phenol are present in said composition in a weight ratio of 98:2 to 2:98.

23. A composition according to claim 22 which is contained in an organic solvent for such.

24. A composition according to claim 23 wherein said solvent is a heavy aromatic naphtha, dimethylformamide or mixtures thereof.

25. A composition according to claim 23 wherein the amine and phenol are present in a weight ratio of 1.5.

26. A composition according to claim 20 wherein the amine is cyclohexylamine.

27. A composition according to claim 26 wherein the amine and phenol are present in said composition in a ratio by weight of 98:2 to 2:98 and said composition is contained in an organic medium.

* * * * *